United States Patent [19]

Brille

[11] Patent Number: 4,502,427

[45] Date of Patent: Mar. 5, 1985

[54] ROCKER ARM FOR AXIAL ENGINE

[75] Inventor: Maurice Brille, 27, rue Parmentier, 9200 Nanterre, France

[73] Assignees: Regie Nationale des Usines Renault, Boulogne-Billancourt; Maurice Brille, Nanterre, both of France

[21] Appl. No.: 472,208

[22] Filed: Mar. 4, 1983

[30] Foreign Application Priority Data

Mar. 4, 1982 [FR] France ..... 82 03576

[51] Int. Cl.[3] ..... F01L 1/18

[52] U.S. Cl. ..... 123/90.41; 123/90.43; 123/58 R

[58] Field of Search ..... 123/90.39, 90.41, 90.42, 123/90.43, 90.23, 58 R, 58 AA, 58 BA

[56] References Cited

U.S. PATENT DOCUMENTS

| | | | |
|---|---|---|---|
| 16205 | 11/1925 | Asbury | 123/90.43 X |
| 2,814,283 | 11/1957 | Gassmann et al. . | |
| 3,198,183 | 8/1965 | Ball | 123/90.42 |
| 3,765,671 | 10/1973 | Blomberg | 123/90.39 X |

FOREIGN PATENT DOCUMENTS

| | | | |
|---|---|---|---|
| 481384 | 11/1916 | France . | |
| 512279 | 1/1921 | France . | |
| 832881 | 10/1938 | France | 123/58 R |
| 853486 | 3/1940 | France | 123/58 R |
| 992883 | 10/1951 | France . | |
| 1295450 | 5/1962 | France . | |
| 339337 | 12/1930 | United Kingdom . | |
| 907099 | 10/1962 | United Kingdom . | |

*Primary Examiner*—Michael Koczo
*Assistant Examiner*—Peggy A. Neils
*Attorney, Agent, or Firm*—Oblon, Fisher, Spivak, McClelland & Maier

[57] ABSTRACT

A timing device for an axial engine comprising for each valve a return spring, a rocker arm and a push rod actuated by a cam. Each rocker arm is pivotably mounted in a rocker arm carrier which is itself mounted so that it can slide in a direction perpendicular to the corresponding valve stem and the position of which in this perpendicular direction is maintained by means of an externally controlled regulating element which actuates this rocker arm which bears on a push rod and the valve stem.

10 Claims, 9 Drawing Figures

FIG.1
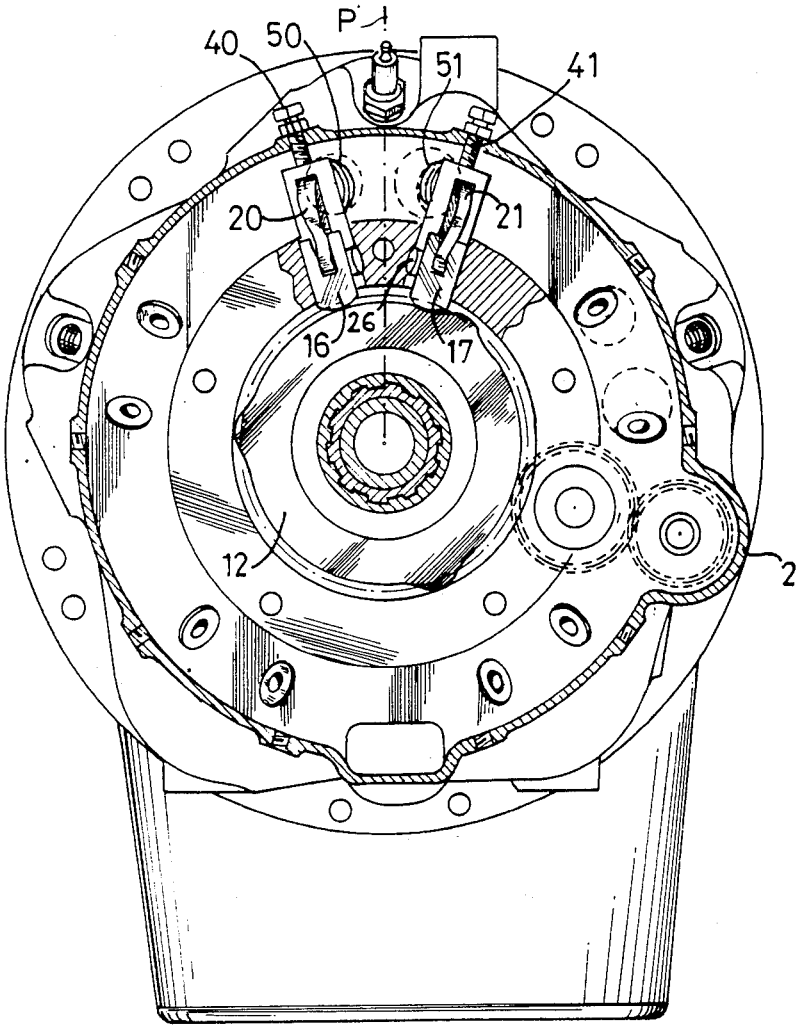
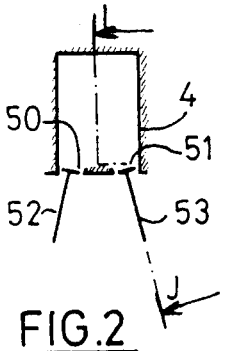
FIG.2

52
53
30
31
20
16
14
13
21
17
15

51
53
41
31
21
22
17
25
34

FIG.8
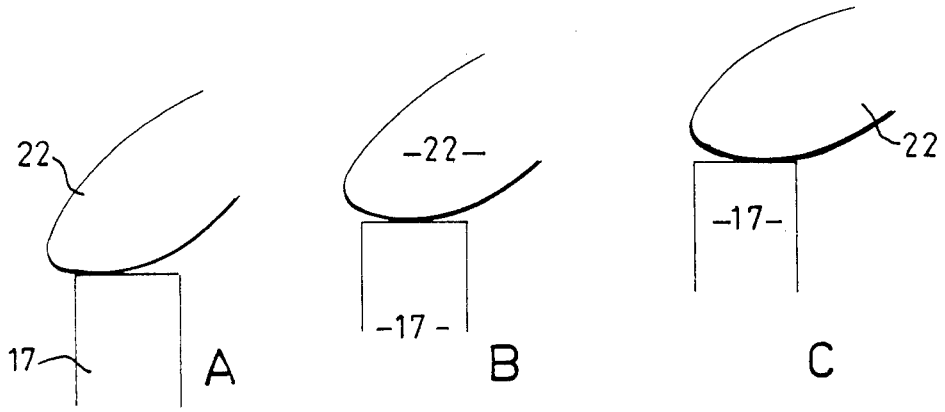
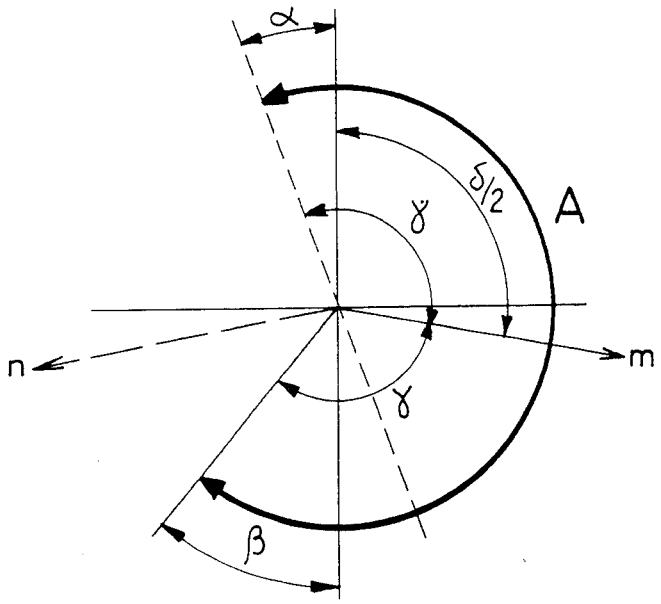
FIG.9

ROCKER ARM FOR AXIAL ENGINE

BACKGROUND OF THE INVENTION

1. Field of the Invention

The present device concerns an axial engine called a barrel engine with controlled ignition or with ignition by compression and concerns in particular a timing device for an axial engine with a rocker arm and a cam-actuated push rod for each valve.

2. Description of the Prior Art

French Pat. No. 2,267,446 (Brille) describes a timing device for an axial engine in which the attempt was made to use cams of existing engines and which had a complicated kinematic chain which could not be generalized when applied to any number of cylinders.

SUMMARY OF THE INVENTION

The present invention uses a timing system derived from those of radial engines, which engines have a certain analogy in the respect with axial engines.

It is known in the area of radial cylindrical aviation engines that all the inlet valves can be regulated by a cam with several lobes and all the exhaust valves by another cam mounted on the same sleeve.

The adaptation of solutions used in the radial engines to axial engines poses, in general, problems of space due to the proximity of all the cylinder heads of the axial engines. These problems cause difficulties in achieving suitable timing movements, in regulating the plays and in mass-production.

The invention has the object of solving these problems. To this end, each rocker arm of the engine is pivotably mounted in a rocker arm carrier which is itself mounted so that it can slide in a direction perpendicular to the corresponding valve shaft and the position of which in this perpendicular direction is maintained by means of an externally controlled regulating element which actuates this rocker arm bearing on a push rod and the valve shaft.

This arrangement permits the space of the axial engine to be sharply reduced due to its compactness. The simplicity of the timing elements permits an economical construction and a smooth operation.

According to another characteristic of the invention the rocker arm push rod and the rocker arm carrier are received in two cylindrical seatings in a fixed annular piece parallel to one another and perpendicular to the axis of the engine and communicating with one another by a space for the passage of the rocker arm.

BRIEF DESCRIPTION OF THE DRAWINGS

Obviously, numerous modifications and variations of the present invention are possible in light of the above teachings. It is therefore to be understood that within the scope of the appended claims, the invention may be practiced otherwise than as specifically described herein.

FIG. 1 is a view of an axial engine according to the present invention in section along a plane passing through the timing cam;

FIG. 2 is a schematic view of a cylinder and its valves;

FIG. 8 is a schematic view showing the mating of the contact surfaces of a rocker arm and of the corresponding push rod; and FIG. 9 is a partial timing graph which allows the shift lag of the push rods to be calculated.

DETAILED DESCRIPTION OF THE PREFERRED EMBODIMENTS

Figure 3:
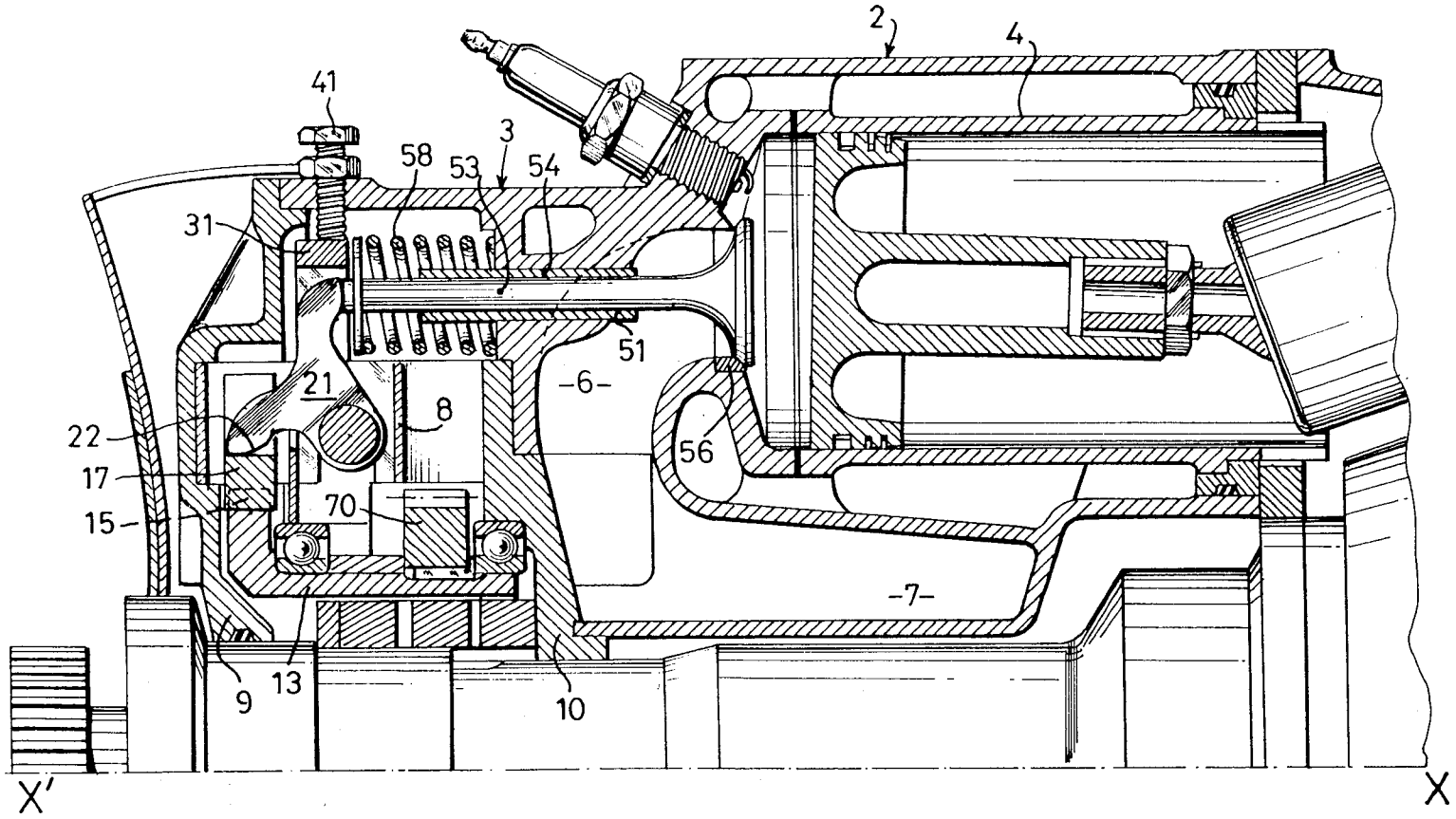
FIG. 3 is a sectional view of a part of the timing linkage along the sectional planes indicated in FIG. 2.

The axial engine shown in FIGS. 1 and 2 has a cylinder block, head 2 and a timing compartment 3. Block 2 has five cylinders 4 regularly spaced around central axis XX′ of the engine and two circuits, one for inlet and one for exhaust as described in French Pat. No. 2,267,446 (Brille), including inlet passages 6 connected to a common annular passage 7. Timing compartment 3 has a fixed annular piece 8 tightly mounted between two covers 9 and 10 and the following timing elements: Cam 12, rocker arm push rods 17, rocker arms 21, rocker arm carriers 31, regulating elements 41, exhaust valves 50 and inlet valves 51, valve guides 54 and valve springs 58.

The timing is provided for each cylinder 4 by two valves, one for the inlet and one for the exhaust. These identical valves are located on a circle centered on axis XX′ in the head, where seats 56 for exhaust valves 50 and inlet valves 51 and seatings for guides 54 of valve stems 52 and 53 are formed. Valves 50 and 51 are regulated by cam 12 which is constituted by drum 13 with cam surfaces 14 on its outer periphery.

Figure 4:
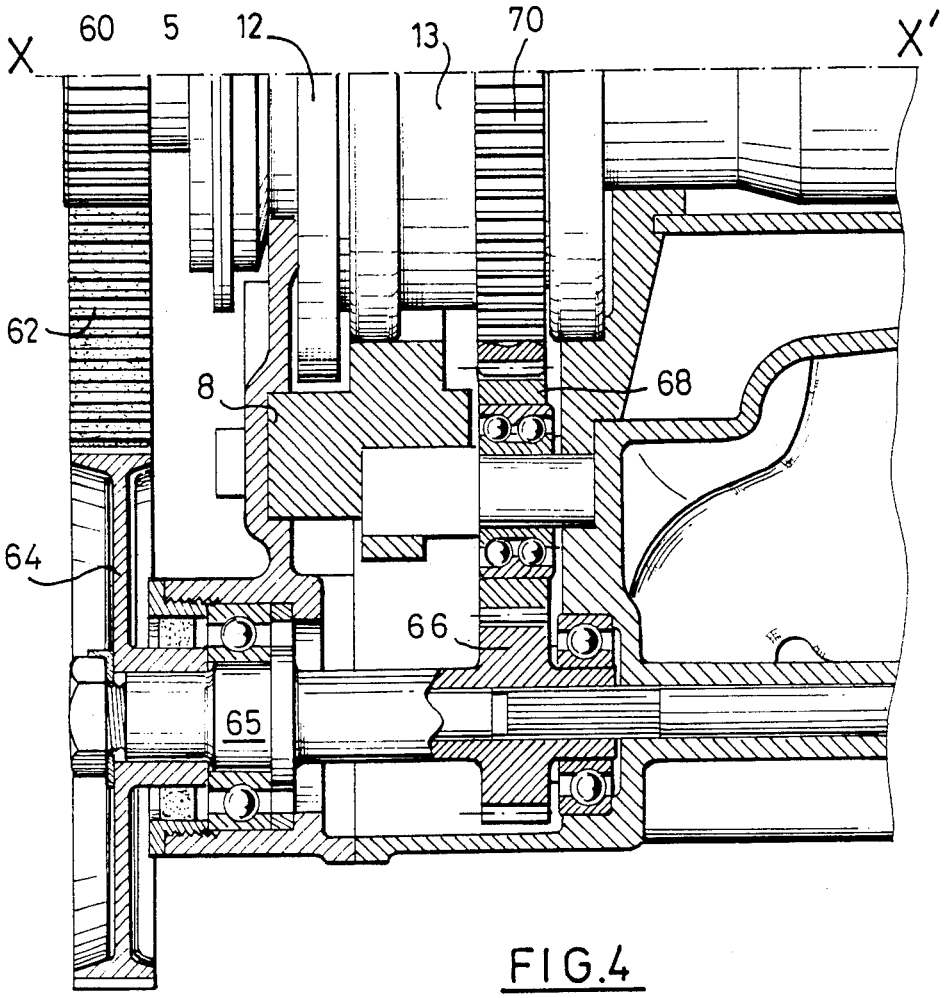
FIG. 4 is a partial view of the axial engine in section along a longitudinal plane passing through the axis of the oil pump, which shows the control of the cam turning, in the example shown, in the same direction as the drive shaft.
Figure 5:
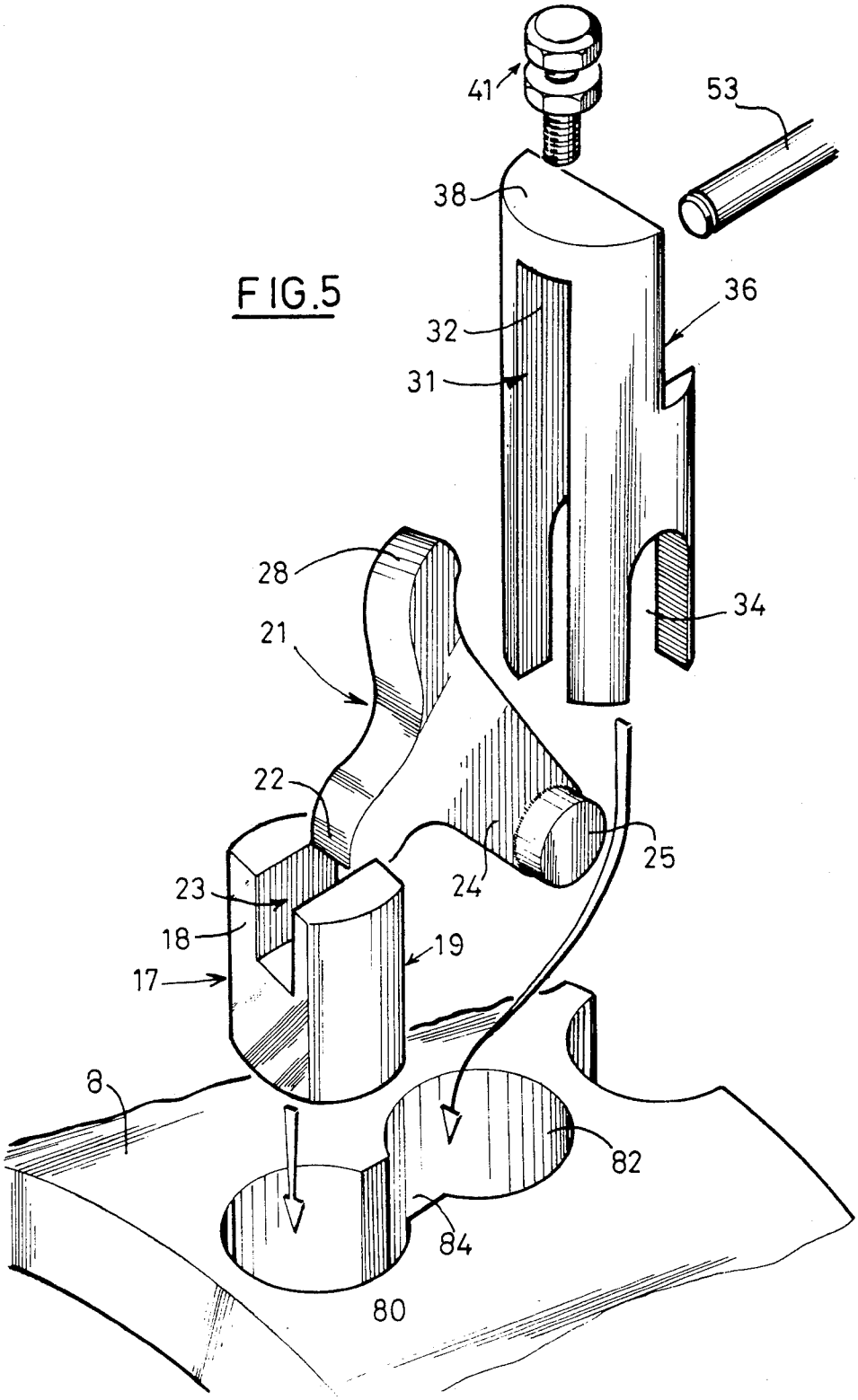
FIG. 5 is an exploded view in perspective showing a push rod, rocker arm and rocker arm carrier assembly located opposite their seating.

Cam 12 rotates concentrically about axis XX′ and is driven, as can be seen from FIGS. 3 and 4, by notched belt 62 from central pinion 60 mounted on drive shaft 5 via a driving gear 64 of shaft 65 from the oil pump, pinion 66 of shaft 65, a second intermediate pinion 68 and a driving gear 70 of cam 12. This gear 70 is mounted on drum 13 of cam 12 and is integral with the latter.

Fixed annular piece 8 is removable and is maintained in position between covers 9 and 10 resting on block 2. This piece 8 is located radially between cam 12 and valve stems 52 and 53. It has pairs of parallel holes 80 and 82 which communicate via space 84. These pairs of identical holes are spread along the periphery of fixed annular piece 8. They are all oriented in relation to central axis XX′ in such a manner that holes 80 are radial and the axes of holes 82 are parallel to those of holes 80. Holes 80 and 82 receive push rod 17 (hole 80) and rocker arm carrier 31 (hole 82), which have cylindrical outer surfaces.

Push rod 17 is in the form of a cylindrical piece provided with two flat spots 18 and 19 parallel to the plane of cam 12 and a groove 23 on the bottom in which rocker arm 21 is supported by one of its ends 22. This groove 23 has the same orientation in relation to axis XX′ as that of pairs of holes 80 and 82.

Rocker arm 21 is a flat monobloc lever composed of a body 24 having a pivot formed by two trunnions 25 and 26. Body 24 extends to form projections at its two ends 22 and 28. These ends rest on push rod 17 (end 22) and on the end of valve stem 52 (end 28).

Rocker arm carrier 31 is a cylindrical piece traversed longitudinally by an axial slot 32 through which rocker arm 21 bears on valve stem 53 by one of its ends 28.

This cylindrical piece also has an axial groove 34 transverse to slot 32. The bottom of groove 34 constitutes the pivot bearings of trunnions 25 and 26 of the rocker arm. Finally, this cylindrical piece has a plane surface 36 perpendicular to slot 32 for preventing this piece from coming in contact with valve spring 58. Externally controlled regulating element 41 mounted on block 2 acts on the face of end 38 of rocker arm carrier 30.

Figures 6, 7:
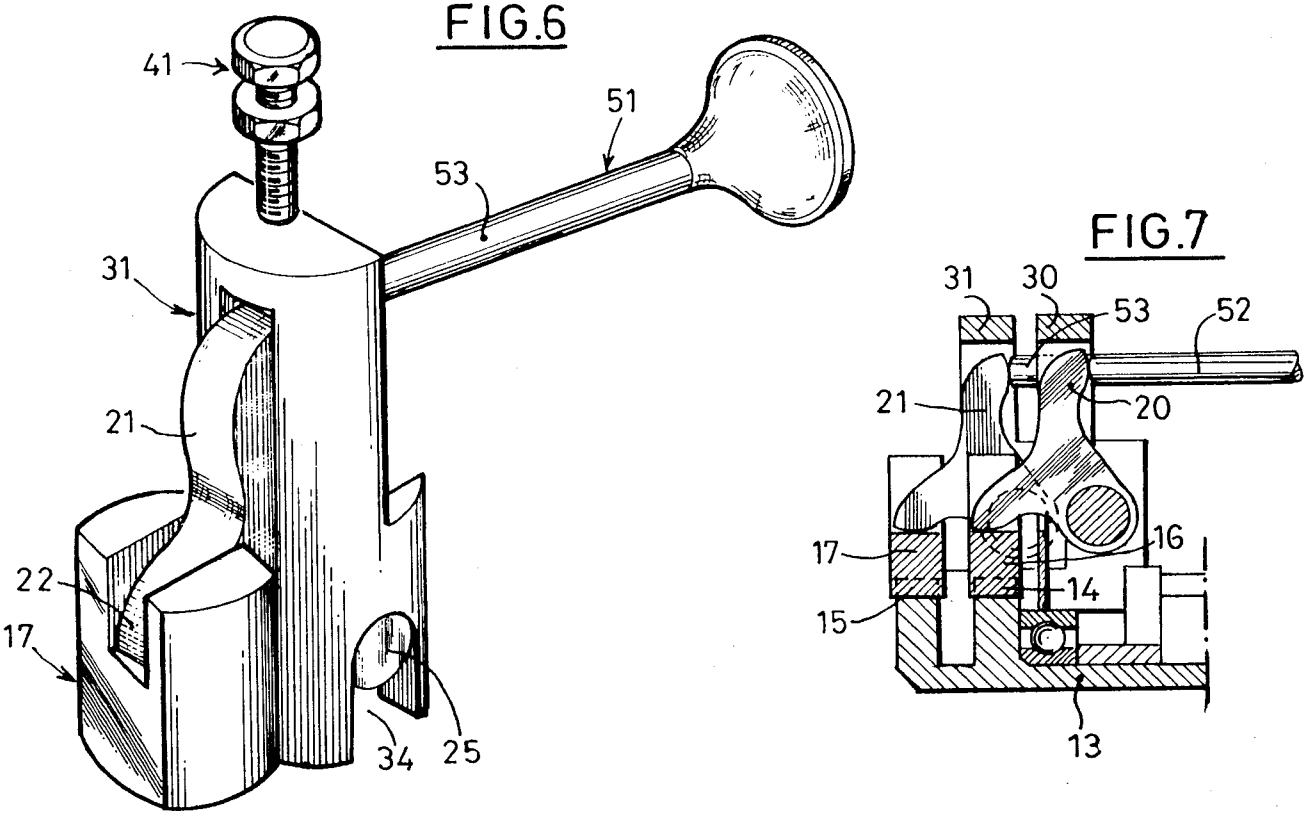
FIG. 6 is a perspective view of a push rod, rocker arm and rocker arm carrier assembly in assembled position.
FIG. 7 is a view in partial section of an embodiment of the axial engine with the two cams for regulating the inlet and the exhaust.

The assembly constituted by the push rod 17, rocker arms 21 and rocker arm carrier 31 is mounted in assembled position in FIG. 6.

FIG. 7 shows the normal construction of an axial engine with two cams for regulating the opening of the inlet and exhaust valves. Single drum 13 has an end with two series of cam surfaces 14 and 15 on its outer periphery. They regulate the shafts of exhaust valve 52 and of inlet valve 53 via push rods 16 and 17, rocker arms 20 and 21, and rocker arm carriers 30 and 31 with a general staggering of the axial position of the two cams.

FIG. 8 is a view which schematically shows the rocker arm in its two end positions (FIGS. 8*a* and 8*c*) and an intermediate position (FIG. 8*b*). These three positions show the particular profile of the partially cylindrical support surface of end 22 of rocker arm 21 in contact with corresponding push rod 17 by the bottom of groove 23. The point of contact of end 22 with the bottom of groove 23 is separated from the axes of trunnions 25 and 26 by a variable distance, because this end rolls on this groove bottom when the push rod is actuated by cam 12. This variable distance thus permits a ratio of variable multiplication of the rocker arm leverage.

The timing device described above operates as follows:

Notched belt 62 (FIG. 4) drives single cam 12 concentrically with the drive shaft and in the same direction of rotation in the examples shown. This single cam regulates push rods 16 and 17, for inlet and exhaust, which directly drive rocker arms 20 and 21. For their part, these rocker arms directly regulate valves 50 and 51.

It is of prime importance that rocker arms 20 and 21 remain in their pivoting planes without turning or shifting laterally, in order to assume a correct operation. This problem is solved by the arrangement of the assemblies of the push rod, rocker arm and rocker arm carrier in the pairs of parallel holes 80 and 82 in fixed annular piece 8.

Rocker arm 21 bearing on push rod 17 and valve stem 53 can rock about its pivot, constituted by the two trunnions 25 and 26, because push rod 17 and rocker arm carrier 31 are immobilized against rotation by this rocker arm.

The axial positioning of rocker arm carrier 31 is obtained by means of regulating element 41 which acts on end surface 38 of the rocker arm carrier.

With a single cam for the inlet and the exhaust, the exhaust valve is driven first, which connects the position of the valves and the direction of rotation of the cam.

It is also necessary to assure a suitable lag between two actuations such as, for example, in a five-cylinder axial engine: With an advance at the inlet opening equal to $\alpha$, a late cut-off equal to $\beta$ and a ratio of the speed of rotation of the camshaft to that of the drive shaft equal to $r=+1/6$, the cam has three lobes angularly spaced by 120° and the lag of the push rod tops of each cylinder is equal to $(\delta/6)$, $\delta$ (FIG. 9):

$$\delta=2(\gamma-\alpha) \text{ with } 2\gamma=\pi+\alpha+\beta$$

(1) with $\alpha=20°$ and $B=40°$, $(1/6)\delta=$approximately 33°
(2) with $\alpha=15°$ and $\beta=45°$, $(1/6)\delta=35°$.

As can be seen from FIG. 8, the timing device of the invention allows the multiplication ratio of the rocker arm leverage to be varied by virtue of the particular structure of the assembly of the push rod, rocker arm and rocker arm carrier and of the partially cylindrical profile of the support surface of the rocker arm end 22 in contact with the push rod. This rocker arm end 22 has such a profile that at the beginning of valve opening the multiplication ratio is minimal (FIG. a), which allows the strains to be reduced in spite of the very great inertia, and that at the end (FIG. c) this ratio is maximal when the valve spring appreciably assures the equilibrium.

This quality allows, for a cam law of optimum lift with very low frictional strains, a minimum lobe height to be used, which permits in certain instances a non-concave cam profile by means of a judicious combination of the values attributed to the radius of the push rod surface in contact with the cam and to the radius of the top of the cam lobe.

With the use of a single cam for the inlet and the exhaust, the valve can not keep its axis parallel to the drive axle as can be envisaged in the case of two distinct cams (FIG. 7). This is due to the fact that the axes of the two push rods for inlet and exhaust must be offset by an angle of $(\delta/6)$, in the vicinity of 33° to 35° in the example selected, and that the two radial planes containing the axes of the valves in the case of two cams forms a dihedron with an angle less than $(\delta/6)$.

As push rods 16 and 17 must operate radially in relation to cam 12, each of the two assemblies comprising a valve, a rocker arm carrier, a rocker arm, a push rod slot and two seatings for the push rod and the rocker arm carrier for the same cylinder 4 is located along a plane defined by the intersection of the radius along which the push rod operates with the axis of the valve shaft symmetrically to the other assembly in relation to plane P passing through the axis of the cylinder and axis XX' of the engine. In the example of the five-cylinder engine chosen the radii along which push rods 16 and 17 operate are separated by an angle in the vicinity of 33° to 35° symmetrically to plane P (see FIGS. 1 and 6).

As is apparent from the preceding description, the timing device of the invention with modular assemblies each formed by a push rod, a rocker arm and a rocker arm carrier allows little space to be required in the timing compartment of an axial engine.

This device allows the play of the rocker arm to be regulated and checked without disassembly.

It is well suited for the spacing of valves and consequently for the use of a single cam for inlet and exhaust.

This last quality results in a better cooling due to the spacing of the inlet and exhaust manifolds and an improvement of the shape of the combustion chamber by a possible approaching of the spark plug to the cylinder axis. It also results in a better machining of the valve seats and valve guides by allowing a significant increase in the diameter of the tool holder, which is thus located almost concentrically to the cylinder axis.

In certain instances the variation of the multiplication ratio of the rocker arm leverage allows a cam profile without concavity and a delicate machining to be used for a given cam law of optimum lift.

The lightening to a large extent of the rocker arm push rod and the association of two trunnions to a flat lever in order to constitute a monobloc rocker arm contribute to a maximum reduction of the total inertia.

The timing elements of the invention have quite simple structures which are advantageous for their manufacture and their mounting and contribute in this manner to reduce the manufacturing cost of the axial engine.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In an axial internal combustion engine having a casing containing at least one valve movable in a first direction, a return spring for each said valve, a cam actuated push rod of each said valve and a rocker arm connecting each said valve with one said push rod, a timing device comprising:

a rocker arm carrier in said casing for each said rocker arm, each said rocker arm being mounted in one said rocker arm carrier, each said rocker arm carrier being movable in a direction perpendicular to said first direction;

a fixed annular piece in said casing, said annular piece having two parallel cylindrical seatings for each said valve, said cylindrical seatings including longitudinal axes which are perpendicular to the axis of said axial engine, said annular piece further having a bore connecting said two seatings, wherein said rocker arm carrier and said push rod are each positioned in one of said seatings, and said rocker arm is positioned in said bore; and regulating means engageable with said rocker arm carrier for adjustably maintaining the position of said rocker arm carrier in said first direction, an adjusting portion of said regulating means extending outside of said casing.

2. Device of claim 1 wherein each of two assemblies, each comprising a valve, a rocker arm carrier, a rocker arm, a push rod slot and two seatings for the push rod and the rocker arm carrier, is located for each cylinder of said engine along a plane defined by the intersection of an axis along which the push rod moves and the axis of the valve in said first direction and is symmetrical to another said assembly in relation to a plane passing through an axis of said cylinder and the axis of said engine.

3. Device of claim 1 including at least two valves and two integral cams for regulating all of said valves, said cams being offset longitudinally in relation to each other, whereby corresponding assemblies, each having one said push rod, rocker arm and rocker arm carrier, have the same longitudinal offset.

4. Device of claim 1 including at least one inlet valve and at least one outlet valve, wherein said device has a single cam which regulates all of said inlet and exhaust valves and successively drives each said push rod for said valves of each cylinder of said engine.

5. Device of claim 4, wherein said engine has five cylinders, and wherein the push rods of the inlet and exhaust valves of each said cylinder are separated by an angle of 33° to 35°.

6. The device of claim 1 wherein said rocker arm is formed as a single piece having trunnions, said rocker arm being pivoted to said carrier via said trunnions.

7. The device of claim 6 wherein said rocker arm carrier comprises a body having a first axial longitudinal slot and a second axial longitudinal slot transverse to said first slot, said trunnions pivoting in said second slot.

8. In an axial internal combustion engine having a casing containing at least one valve movable in a first direction, a return spring for each saiid valve, a cam actuated push rod of each said valve and a rocker arm connecting each said valve with one said push rod, a timing device comprising:

a rocker arm carrier in said casing for each said rocker arm, each said rocker arm being mounted in one said rocker arm carrier, each said rocker arm carrier being movable in a direction perpendicular to said first direction; and regulating means engageable with said rocker arm carrier for adjustably maintaining the position of said rocker arm carrier in said first direction, an adjusting portion of said regulating means extending outside of said casing, wherein said push rod has two parallel flat portions having surfaces parallel to the rocker arm pivot axis and a groove on the bottom of which said rocker arm is supported.

9. Device of claim 8 wherein said rocker arm defines a partially cylindrical support surface engageable with the plane face of the bottom of said groove of said push rod, said support surface being shaped so that at the commencement of the valve lift the multiplication ratio is minimal and at the end of the valve lift this ratio is maximal.

10. Device of claim 1 wherein said cam has a lobe height for a given valve lift of a valve such that the cam profile does not have concavities.

* * * * *